US006676469B2

(12) United States Patent
Murtishaw et al.

(10) Patent No.: US 6,676,469 B2
(45) Date of Patent: Jan. 13, 2004

(54) SYSTEM AND METHOD FOR PROTECTING CATHODE RAY TUBE FUNNELS FROM CONTAMINATION AFTER APPLICATION OF INTERIOR COATING

(75) Inventors: David Allen Murtishaw, Sun City, CA (US); Edward Martinez, Vista, CA (US); Brian Solomich, Vista, CA (US)

(73) Assignees: Sony Corporation, Tokyo (JP); Sony Electronics, Inc., Park Ridge, NJ (US)

( * ) Notice: Subject to any disclaimer, the term of this patent is extended or adjusted under 35 U.S.C. 154(b) by 239 days.

(21) Appl. No.: 09/839,432

(22) Filed: Apr. 20, 2001

(65) Prior Publication Data

US 2002/0155778 A1 Oct. 24, 2002

(51) Int. Cl.[7] ..... H01J 9/20

(52) U.S. Cl. ..... 445/22; 445/23; 445/24; 445/25; 445/45

(58) Field of Search ..... 445/22, 23, 24, 445/25, 44, 45, 66, 70, 73, 43

(56) References Cited

U.S. PATENT DOCUMENTS 4,527,042 A * 7/1985 Shinohara et al.
4,979,919 A * 12/1990 Toyama
5,277,640 A * 1/1994 Shinmyou et al.
5,829,163 A * 11/1998 Park et al.
6,015,288 A * 1/2000 Mundon

* cited by examiner

*Primary Examiner*—Anthony Dinkins
*Assistant Examiner*—Nguyen T. Ha
(74) *Attorney, Agent, or Firm*—Steven L. Nichols

(57) ABSTRACT

During manufacture, the components of a cathode ray tube must be protected against contaminants, such as dust, that will degrade performance of the completed tube. A protective tunnel, in which a contaminant-free environment can more easily be maintained, protects open cathode ray tube funnels that are moved between a coating station and a drying oven. Access doors may be provided to allow for cleaning and maintenance of the tunnel, as well as access to cathode ray tube funnels in the tunnel. A vacuum system may also be provided to clean airborne contaminants from the protective tunnel.

17 Claims, 6 Drawing Sheets

SYSTEM AND METHOD FOR PROTECTING CATHODE RAY TUBE FUNNELS FROM CONTAMINATION AFTER APPLICATION OF INTERIOR COATING

FIELD OF THE INVENTION

The present invention relates to the field of sensitive manufacturing processes that require, at least in part, a contaminant-free environment. More specifically, the present invention relates to the field of cathode ray tube manufacture, particularly the processing of cathode ray tube funnels after an interior coating has been applied. The present invention provides a system and method for better ensuring that no contaminants lodge in a cathode ray tube funnel after an interior coating has been applied, but before the tube is sealed.

BACKGROUND OF THE INVENTION

Cathode ray tubes ("CRTs") are used in most television sets and computer and video monitors. A typical CRT is illustrated in FIG. 1. The CRT (100) is a glass tube with a bottle-like shape in which a relatively flat bottom portion (101) narrows into an elongated neck portion (102). The relatively flat portion (101) of the CRT (100) becomes the screen on which the display of the television set or monitor is generated when the CRT is incorporated therein. An electro-luminescent material, such as phosphorus, that emits light when struck by an electron beam, is coated over the interior of the screen portion (101) of the CRT (100).

An electron gun (not shown) is then installed in the neck (102) of the CRT (100).

A stream of electrons emitted from the electron gun is scanned over the electro-luminescent layer and turned on and off during the scanning to cause the electro-luminescent layer to glow in certain places and not others. In very simple terms, this is how an image is generated on the screen of a television or video monitor.

A yoke (not shown) is provided around the neck (102) of the CRT (100). This yoke produces a changing magnetic field through which the electron beam from the electron gun passes. The electron beam is deflected by the magnetic field of the yoke. Consequently, by varying the magnetic field created by the yoke in a precise cycle, the electron beam can be scanned, line-by-line, over the entire surface of the screen to generate video images thereon.

It is very important to ensure that no dust or other contaminants are allowed into the CRT (100) during its construction. Contaminants that remain in the CRT (100) when it is operating can degrade the performance of the CRT (100) and even cause damage to the tube by, for example, intefering with the operation of the electron gun and the emitted electron stream.

A cathode ray tube is generally constructed in the following matter. The neck (102) or funnel portion of the CRT (100) is formed open at both ends. Then the relatively flat bottom, or display portion (101) is sealed to the large end of the funnel and the electron gun is installed in the narrow end or neck of the funnel.

The display portion (101) is sealed to the funnel (102) using frit. Frit is a glass paste that can be cured or hardened. Frit (103), in paste form, is applied around the large end of the funnel (102) between the funnel (102) and the display portion (101). The frit is cured or hardened to form a frit seal (103) between the funnel (102) and the display portion (101).

Before the funnel (102) and display (101) portions are sealed, coatings are applied to the interior of the funnel (102). These coatings including carbon material necessary to the optimal operation of the CRT (100).

Obviously, while working with the open funnels to apply the necessary interior coating before the tubes are sealed with a display portion, contaminants, such as dust, moisture, particulate matter, etc., can be introduced to and lodge in the open funnels. As noted above, this contamination can degrade the performance of the finished CRT.

Consequently, there is a need in the art for systems and methods that will minimize or eliminate contaminants that may be introduced into cathode ray tubes during manufacture. In particular, there is a need for an improved system and method of preventing any such contamination from being introduced into the open funnel of a cathode ray tube after interior coating has been applied, but before the tube has been sealed closed.

SUMMARY OF THE INVENTION

The present invention meets the above-described needs and others. Specifically, the present invention provides an improved system and method of preventing contaminants from being introduced into the open funnel of a cathode ray tube after an interior coating has been applied, but before the tube has been sealed closed.

Additional advantages and novel features of the invention will be set forth in the description which follows or may be learned by those skilled in the art through reading these materials or practicing the invention. The advantages of the invention may be achieved through the means recited in the attached claims.

The present invention may be embodied and described as a system for minimizing contamination of cathode ray tube components during manufacture. The system preferably includes a shielded transport path that prevents contaminants from reaching components of cathode ray tubes moving in the transport path, where a first end of the shielded transport path receives the components of cathode ray tubes from a first workstation; and a second end of the shielded transport path outputs the components of cathode ray tubes to a second workstation.

In a particularly preferred embodiment, the shielded transport path is a transport path enclosed in a tunnel. The tunnel preferably includes at least one access door for accessing the enclosed transport path in the tunnel. The tunnel may also include an intake for a vacuum system used to clean the tunnel.

In a preferred embodiment, the cathode ray tube components are funnels; the first workstation is a carbon coating application station; and the second workstation is a drying oven tunnel through which the transport path is routed. This is a particularly contaminant-sensitive portion of the manufacturing process that would benefit from application of the present invention. In such a case, the transport path would preferably be a conveyor that transports pallets, each of which supports one of the funnels.

The present invention also encompasses the methods of making and using the system described above. More specifically, the present invention may encompass a method of minimizing contamination of cathode ray tube components during manufacture by shielding a transport path with shielding that prevents contaminants from reaching components of cathode ray tubes moving in the transport path, where a first end of the shielded transport path receives the components of cathode ray tubes from a first workstation;

and a second end of the shielded transport path outputs the components of cathode ray tubes to a second workstation. The method preferably includes shielding the transport path by enclosing the transport path in a tunnel.

The method may also include providing at least one access door in a side of the tunnel for accessing an interior of the tunnel. The method may also include cleaning the interior of the tunnel to remove contaminants. This may be performed by operating a vacuum system connected to the tunnel.

BRIEF DESCRIPTION OF THE DRAWINGS

The accompanying drawings illustrate preferred embodiments of the present invention and are a part of the specification. Together with the following description, the drawings demonstrate and explain the principles of the present invention.

FIG. 2 illustrates a protective tunnel for conveying cathode ray tube funnels between a coating station and a drying oven.

Throughout the drawings, identical elements are designated by identical reference numbers.

DETAILED DESCRIPTION OF THE PREFERRED EMBODIMENTS

In general principle, the present invention provides a protective tunnel in which a contaminant-free environment can more easily be obtained. The cathode ray tube funnels are moved through the protective tunnel during contaminant-sensitive portions of the manufacturing process, such as when the open funnel has not yet been sealed and is moving between a coating application station and a drying oven. Points in a production line, such as a coating application station or a drying oven, where work, other than mere transportation, is performed on components of a cathode ray tube to advance the completion of a tube are referred to as "workstations."

Figure 1:
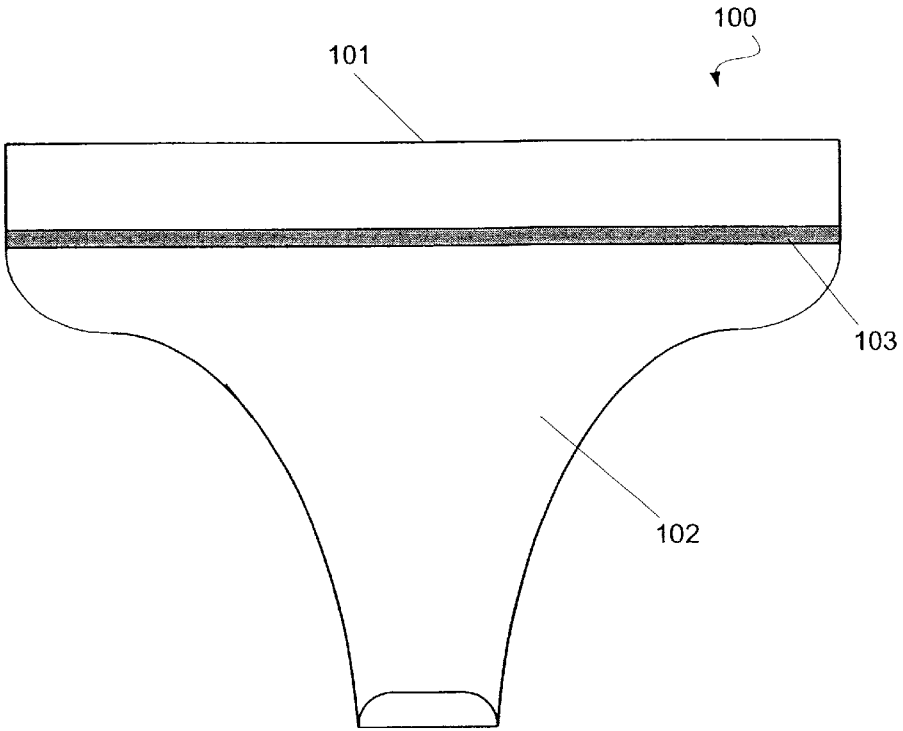
Fig. 1 Prior Art
FIG. 1 is an illustration of a typical cathode ray tube to the manufacture of which the present invention can be profitably applied.
Figure 2:
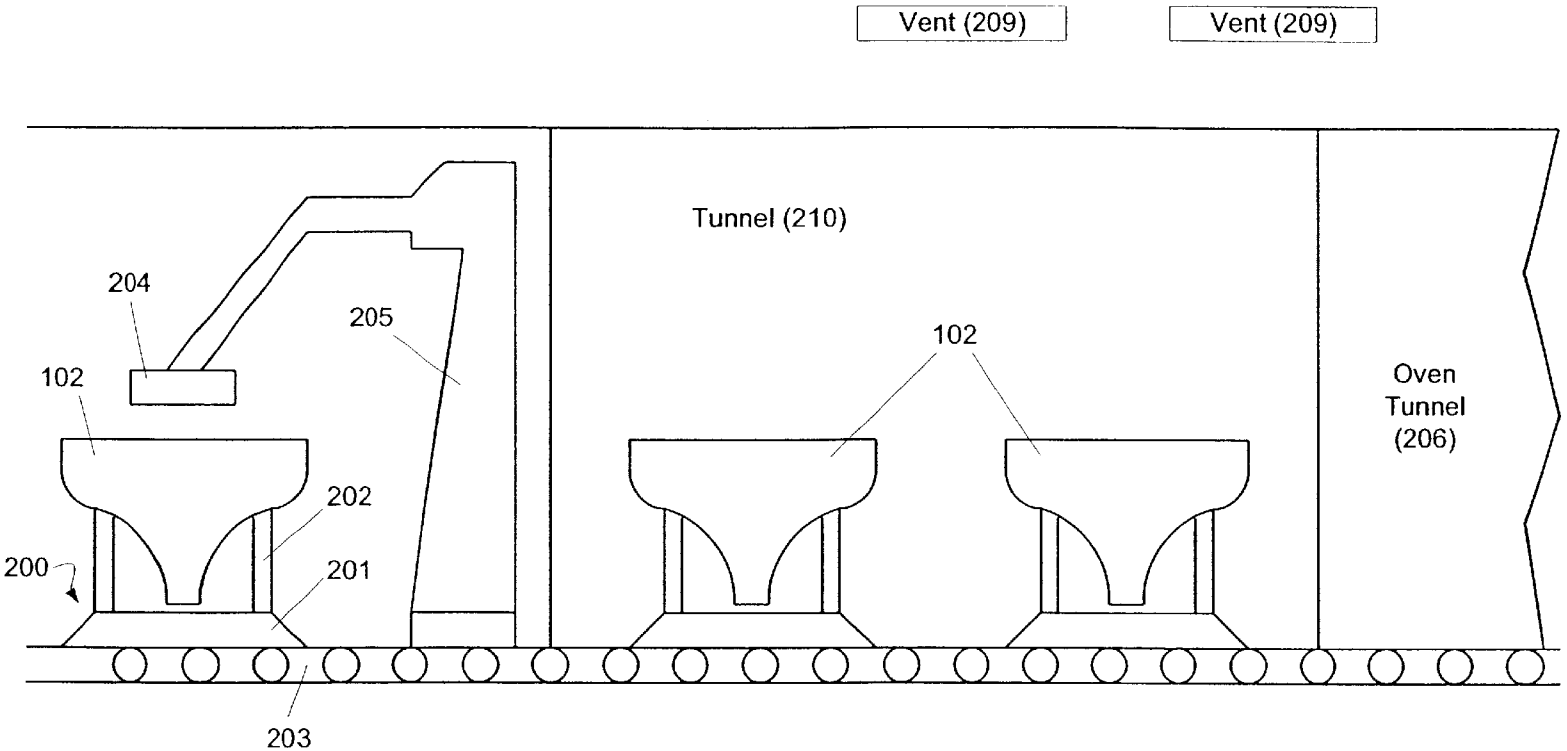
FIG. 2 is an illustration of a system according to the present invention for processing cathode ray tube funnels after an interior coating has been applied so as to prevent or minimize the introduction of contaminants into the funnels.

Using the drawings, the preferred embodiments of the present invention will now be explained. FIG. 2 illustrates a contaminant-sensitive portion of the cathode ray tube manufacturing processes and the improvements of the present invention.

As shown in FIG. 2, cathode ray tube funnels (102) are supported during processing on holders or pallets (200). The pallets (200) include a base (201) with supports (202) that hold the funnel (102) in an upright position with the open, large end of the funnel (102) pointing upward. The pallets (200) carrying the funnels (102) may be transported on a conveyor (203).

First, each funnel (102) is brought to a coating application station (205). At the coating application station (205), a coating of, for example, carbon material, is sprayed into the interior of the funnel (102). A spray head (204) sprays the coating into the open interior of the funnel (102) as the funnel (102) is supported on the pallet (200).

Next, the funnel (102) is conveyed into and through a drying oven (206) to dry the newly-applied coating. Transport between the coating application station (205) and the drying oven (206) is a particularly sensitive time in the manufacturing process. With the funnel (102) being open and held upright on the pallet (200), and with a wet coating on the funnel's interior, it is a likely time for contaminants to be introduced to and lodge in the funnel (102). As described above, if is occurs, these contaminants will degrade and possibly damage the operation of the cathode ray tube made from the contaminated funnel.

For example, there are likely to be vents (209) in the area to allow excess heat from the oven tunnel (206) to escape. These vents (209), and the ventilation system to which they are connected, can be an obvious avenue for introducing contaminants into the area. The contaminants may then very easily end up in the funnels (102) being processed.

To preclude contaminants from this and other sources from being introduced into the funnels (102) during this sensitive portion of the manufacturing process, the present invention calls for a protective tunnel (210) to be constructed between the coating application station (205) and the drying oven tunnel (206). In one embodiment, the protective tunnel (210) may merely be a shield running above the transport path of the conveyor (203) between the vents (209) and the funnels (102). However, in a more preferred embodiment, the protective tunnel (210) totally encloses the transportation path of the pallets (200) and funnels (102).

Figure 3:
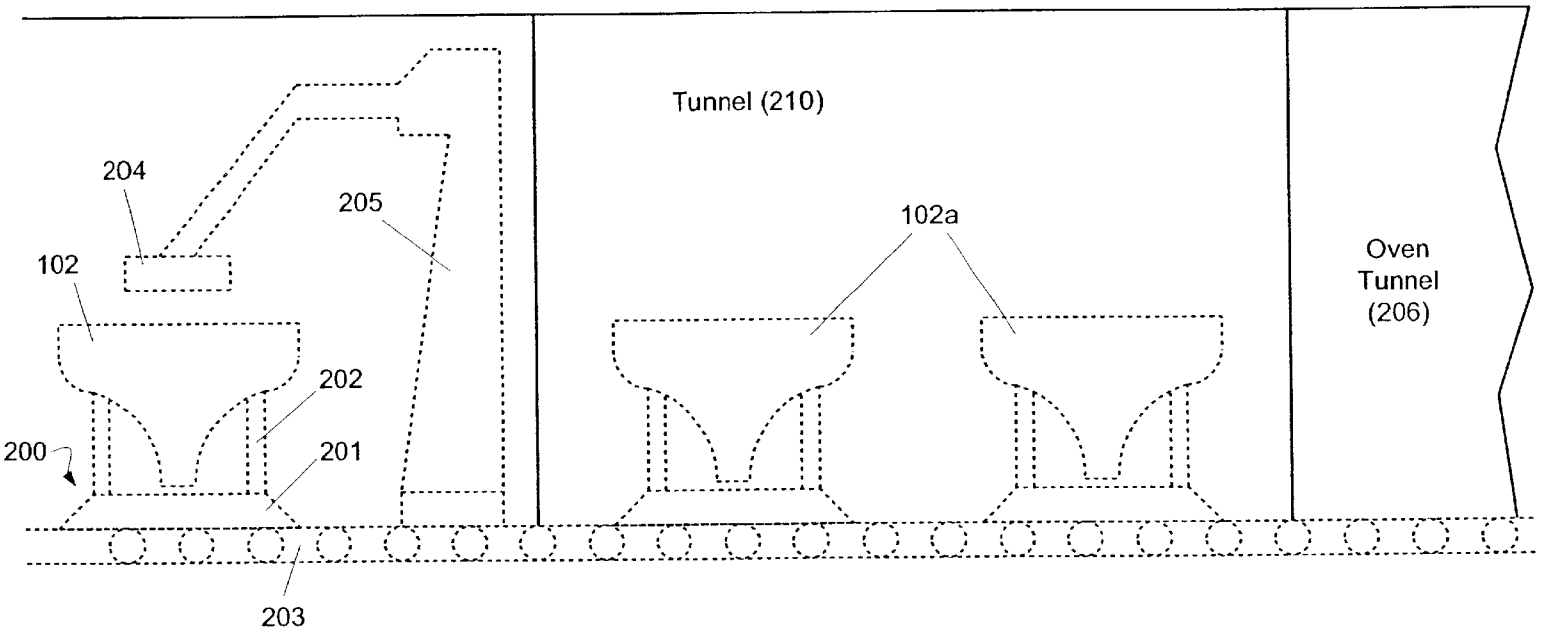
FIG. 3 is an illustration of the system shown in FIG. 2 in which elements enclosed in protective housings are identified.

FIG. 3 illustrates this more preferred embodiment in which the protective tunnel (210) totally encloses the transportation path of the pallets (200) and funnels (102). For clarification, those elements that are within the enclosed space of the protective tunnel (201) are illustrated in ghost. Thus, the two illustrated funnels (102*a*) that are moving between the coating application station (205) and the oven tunnel (206) are enclosed within the protective tunnel (210) and are accordingly illustrated in ghost.

It should be noted that the coating application station (205) is also enclosed in a protected environment and is illustrated in ghost, along with the pallet (200) and funnel (102) located at the coating application station (205). Thus, the protective tunnel (210) extends the protected environment until the coated funnels (102*a*) are introduced into the oven tunnel (206).

Preferably, the conveyor (203) is also within the protected environment of the tunnel (210). Consequently, the conveyor (203) is also illustrated in ghost in FIG. 3.

Under the principles of the present invention, the protective tunnel (210) creates and defines a protected environment that can much more readily be kept free of potential contaminants than can a larger, unenclosed space. For example, the tunnel (210) prevents contaminants emerging from the vents illustrated in FIG. 2 from reaching the funnels (102*a*).

Figure 4:
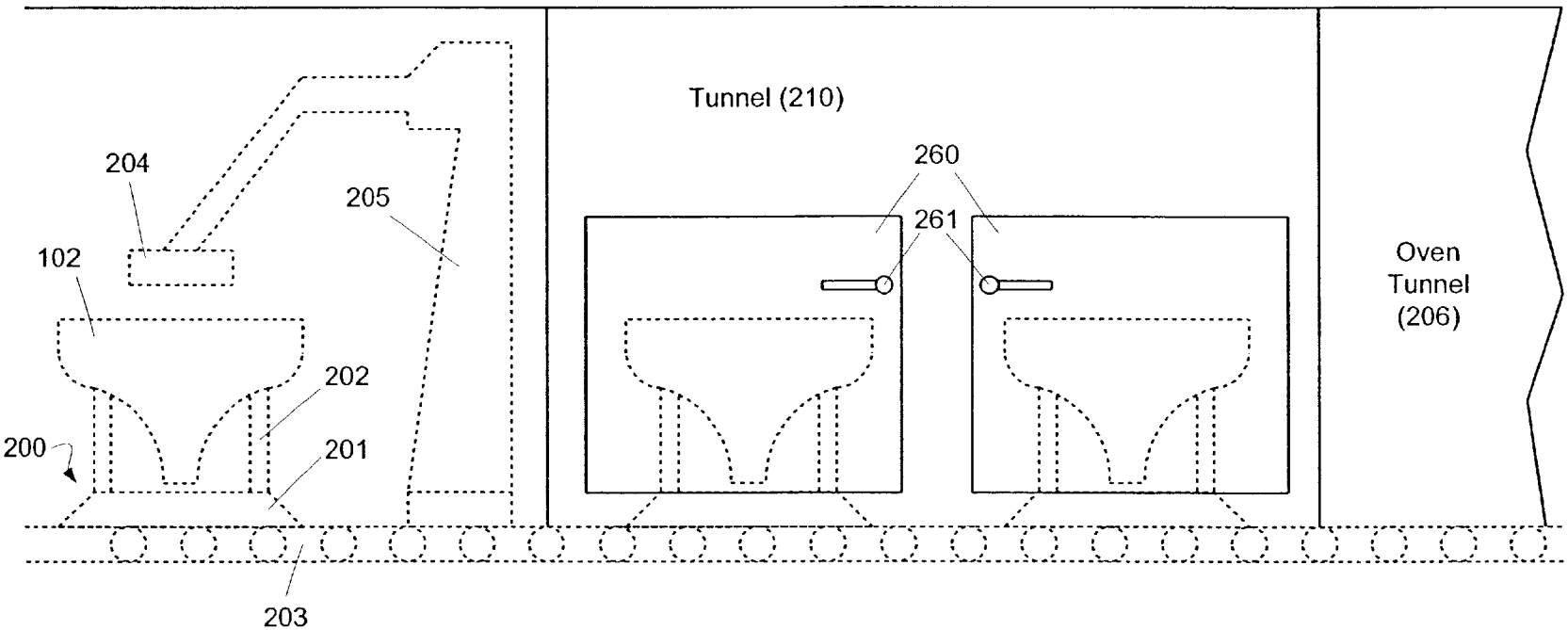
FIG. 4 is an illustration of a second embodiment of the system shown in FIG. 2 in which access doors are provided into a protective tunnel for conveying cathode ray tube funnels between a coating station and a drying oven.

FIG. 4 illustrates another possible embodiment of the present invention. As shown in FIG. 4, access doors (260) are provided in the protective tunnel (201) between the coating application station (205) and the oven tunnel (206). A single access door may be provided under the principles of the present invention. However, for convenience, two doors, as shown in FIG. 4, are preferred. Each door (260) has a handle (261) for opening and closing the door (260).

An access door or doors (260) may be necessary to access the interior of the tunnel (210) and the coated funnels (102) on their respective pallets (200) in several circumstances. For example, if some subsequent part of the production line experiences a slowdown or shut down, such as a malfunction in the oven tunnel (206), it may be desirable or necessary to remove coated funnels from the tunnel (210). Additionally, if the conveyor (203) malfunctions or the tunnel (210) requires cleaning or repairs, the access doors (260) can be used to provide those services.

Figure 5:
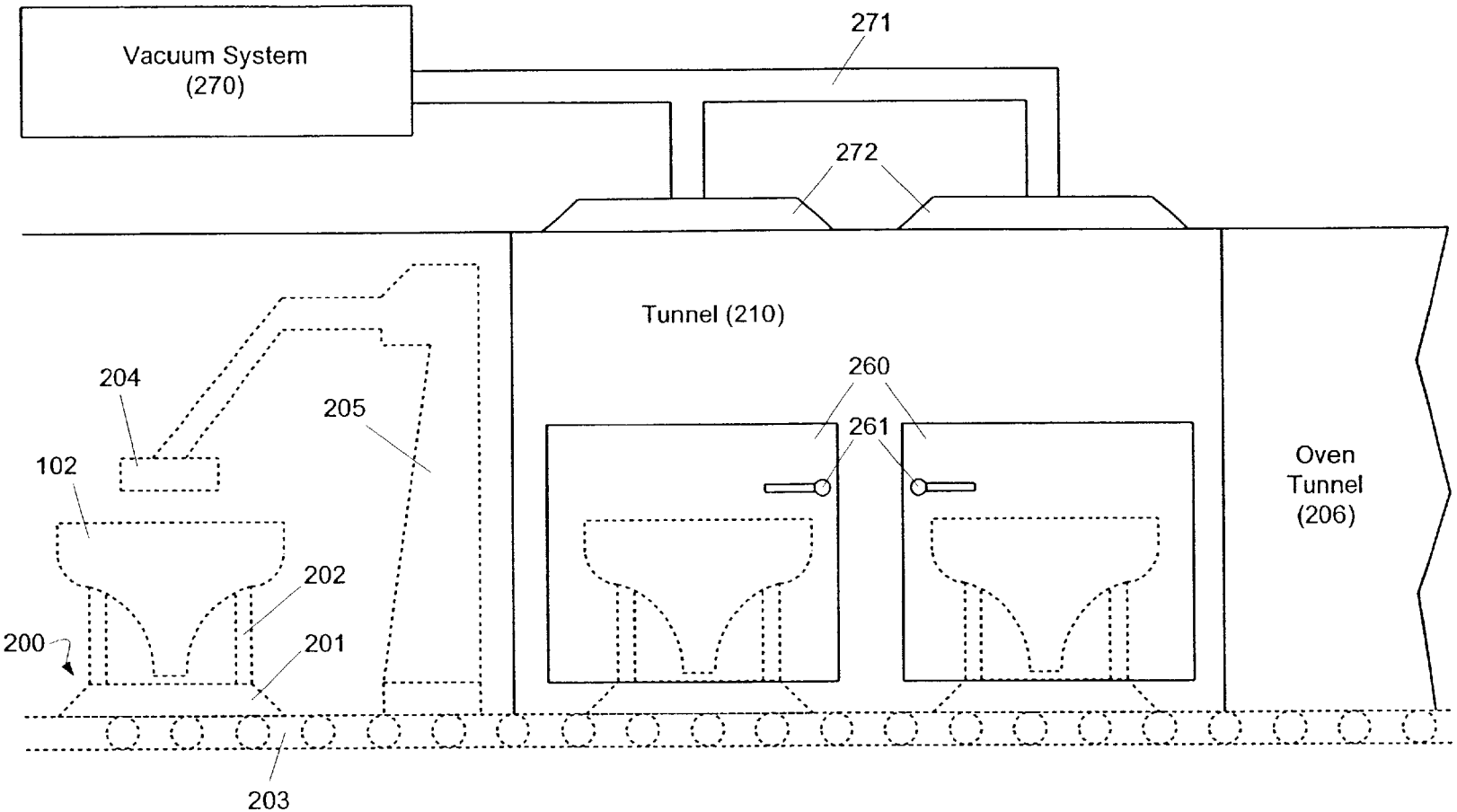
FIG. 5 is an illustration of a third embodiment of the system shown in FIG. 2 in which a vacuum system is provided for maintaining a clean environment in the protective tunnel for conveying cathode ray tube funnels between a coating station and a drying oven.

FIG. 5 illustrates a third possible embodiment of the present invention. As shown in FIG. 5, a vacuum system (270) may be connected to the protective tunnel (210). This vacuum system (270) can be used to help maintain a contaminant-free environment within the protective tunnel (210).

As shown in FIG. 5, the vacuum system (270) includes at least one, preferably more, intakes (272) that pull air and contaminants from within the protective tunnel (210) into the vacuum system (270). A tubing or piping system (271) connects the vacuum system (270) with the intake(s) (272).

The vacuum system (270) can be operated, particularly when funnels are not in the tunnel (210), to remove potential contaminants that may have somehow been introduced into the tunnel (210). Operating the vacuum system (270) when funnels are in the tunnel (210) could adversely affect the wet coating applied at the coating application station (205).

Figure 6:
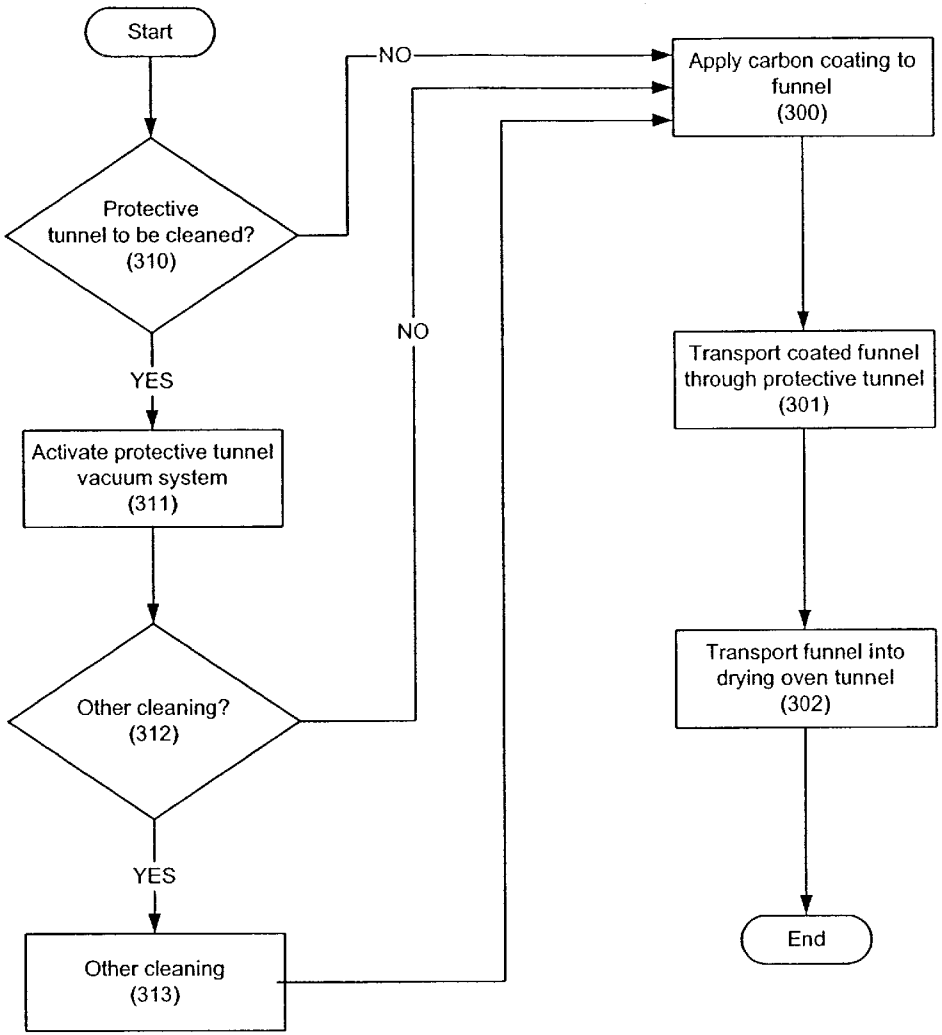
FIG. 6 is a flowchart illustrating the method of the present invention for protecting cathode ray tube funnels from contamination.

FIG. 6 is a flow chart illustrating various aspects of the method of the present invention. This flow chart illustrates how all the various aspects of the invention discussed above can be operated together, but should not be read as requiring that any embodiment of the present invention include all the disclosed features such as access doors and/or a vacuum system.

As shown in FIG. 6, it is necessary to keep the protective tunnel clean and as free of possible contaminants as possible. Consequently, the method may begin with an evaluation of the cleanliness of the tunnel (310). If the tunnel is sufficiently clean, the coating application station can being or continue applying coatings to the interiors of the passing funnels (300). The funnels are then transported through the protective tunnel (301) and into the drying oven tunnel (302). In this way, the present invention protects against contamination of the funnels that may occur at this sensitive portion of the manufacturing process and, thereby, improves the quality of the cathode ray tubes being produced.

If the tunnel is not sufficiently clean (310), the tunnel can be cleaned. First, the vacuum system, if one is connected to the protective tunnel, may be activated (311). The vacuum system will clean contaminants, particularly airborne contaminants, from within the protective tunnel.

If no vacuum system is provided or if the vacuum system has not sufficiently cleaned the protective tunnel, additional cleaning may be needed (312). This additional cleaning may include manual cleaning of the tunnel through the access doors (if access doors are provided). If no additional cleaning is needed, coated funnels may be moved through the tunnel after the vacuum system has completed its work (300–302). If however, additional cleaning is needed, it is the performed (313) before coated funnels are moved through the tunnel (300–302).

The preceding description has been presented only to illustrate and describe the invention. It is not intended to be exhaustive or to limit the invention to any precise form disclosed. Many modifications and variations are possible in light of the above teaching.

The preferred embodiment was chosen and described in order to best explain the principles of the invention and its practical application. The preceding description is intended to enable others skilled in the art to best utilize the invention in various embodiments and with various modifications as are suited to the particular use contemplated. It is intended that the scope of the invention be defined by the following claims.

What is claimed is:

1. A system for minimizing contamination of cathode ray tube components during manufacture, said system comprising:

a shielded transport path that prevents contaminants from reaching components of cathode ray tubes moving in said transport path;

a first end of said shielded transport path receiving said components of cathode ray tubes from a first workstation; and a second end of said shielded transport path outputting said components of cathode ray tubes to a second workstation;

wherein:

said cathode ray tube components are funnels;

said first workstation is a carbon coating application station; and said second workstation is a drying oven tunnel through which said transport path is routed.

2. The system of claim 1, wherein said shielded transport path further comprises a transport path enclosed in a tunnel.

3. The system of claim 2, wherein said tunnel farther comprises at least one access door for accessing said enclosed transport path in said tunnel.

4. The system of claim 2, wherein said tunnel further comprises at least one intake for a vacuum system used to clean said tunnel.

5. The system of claim 1, wherein:

said transport path comprises a conveyor that transports pallets, each of which supports one of said funnels.

6. A method of minimizing contamination of cathode ray tube components during manufacture, said method comprising:

shielding a transport path with shielding that prevents contaminants from reaching components of cathode ray tubes moving in said transport path;

wherein:

a first end of said shielded transport path receives said components of cathode ray tubes from a first workstation;

a second end of said shielded transport path outputs said components of cathode ray tubes to a second workstation;

said cathode ray tube componenets are funnels;

said first workstation is a carbon coating application station; and said second workstation is a drying oven tunnel through which said transport path is routed.

7. The method of claim 6, wherein said shielding said transport path further comprises enclosing said a transport path in a tunnel.

8. The method of claim 7, wherein said shielding further comprises providing at least one access door in a side of said tunnel for accessing an interior of said tunnel.

9. The method of claim 7, further comprising cleaning an interior of said tunnel to remove contaminants.

10. The method of claim 9, wherein said cleaning comprises operating a vacuum system connected to said tunnel.

11. A system for minimizing contamination of cathode ray tube components during manufacture, said system comprising:

transport means for transporting components of cathode ray tubes in a transport path; and shield means for shielding said transport means to prevent contaminants from reaching components of cathode ray tubes moving in said transport path;

wherein:

a first end of said transport path receives said components of cathode ray tubes from a first workstation;

a second end of said transport path outputs said components of cathode ray tubes to a second workstation;

said cathode ray tube components are funnels;

said first workstation is a carbon coating application station; and said second workstation is a drying oven tunnel through which said transport path is routed.

12. The system of claim 11, wherein said shield means comprises enclosure means for enclosing said a transport path.

13. The system of claim 12, wherein said enclosure means comprise at least one access means for accessing an interior of said enclosure means.

14. The system of claim 11, further comprising cleaning means for cleaning an interior of said shield means to remove contaminants.

15. The system of claim 14, wherein said cleaning means comprise a vacuum system connected to said enclosure means.

16. The system of claim 5, wherein:

said shielded transport path comprises a transport tunnel; and said conveyor is enclosed within said transport tunnel.

17. The method of claim 6, wherein said transport path comprises a conveyor and said method further comprises enclosing said conveyor of said transport path in said tunnel.

* * * * *

UNITED STATES PATENT AND TRADEMARK OFFICE

CERTIFICATE OF CORRECTION

PATENT NO. : 6,676,469 B2 
DATED : January 13, 2004
INVENTOR(S) : David Allen Murtishaw, Edward Martinez and Brian Solomich It is certified that error appears in the above-identified patent and that said Letters Patent is hereby corrected as shown below:

Column 6,
Line 38, change "wherein said tunnel farther comprises" to -- wherein said tunnel further comprises --.
Line 60, change "cathode ray tube componenets are funnels" to -- cathode ray tube components are funnels --.
Line 66, change "enclosing said a transport" to -- enclosing said transport --.

Column 8,
Line 4, change "enclosing said a transport" to -- enclosing said transport --.

Signed and Sealed this

Sixteenth Day of March, 2004

JON W. DUDAS
*Acting Director of the United States Patent and Trademark Office*